US005662493A

United States Patent [19]

Reichle

[11] Patent Number: 5,662,493

[45] Date of Patent: Sep. 2, 1997

[54] MULTIPLE CONTACT PIN HOLDER FOR WEAK CURRENT INSTALLATIONS

[75] Inventor: Hans Reichle, Wetzikon, Switzerland

[73] Assignee: Reichle + De-Massari AG, Wetzikon, Switzerland

[21] Appl. No.: 401,621

[22] Filed: Mar. 9, 1995

[30] Foreign Application Priority Data

Mar. 10, 1994 [CH] Switzerland ..... 716/94

[51] Int. Cl.[6] ..... H01R 4/26; H01R 4/24

[52] U.S. Cl. ..... 439/409; 379/397; 439/341; 439/399; 439/407; 439/942

[58] Field of Search ..... 379/397, 326, 379/327; 439/399, 400, 410, 341, 452, 409, 942, 417, 404, 405, 407

[56] References Cited

U.S. PATENT DOCUMENTS

| | | | |
|---|---|---|---|
| 3,835,445 | 9/1974 | Hardesty | 439/410 |
| 4,191,442 | 3/1980 | Caveney et al. | 439/400 |
| 4,496,206 | 1/1985 | Markwardt et al. | 439/409 |
| 4,834,670 | 5/1989 | Rodondi et al. | 439/399 X |
| 4,836,803 | 6/1989 | Seidel | 439/942 X |
| 5,120,235 | 6/1992 | Kashiwa | 439/399 X |
| 5,273,462 | 12/1993 | Huser et al. | 439/341 X |
| 5,547,391 | 8/1996 | Benes et al. | 439/399 |
| 5,573,421 | 11/1996 | Reichle | 439/409 |
| 5,577,930 | 11/1996 | Dahlem et al. | 439/399 |

FOREIGN PATENT DOCUMENTS

| | | |
|---|---|---|
| 0 057 579 | 8/1982 | European Pat. Off. . |
| 0 310 832 | 4/1989 | European Pat. Off. . |
| 0 427 132 | 5/1991 | European Pat. Off. . |
| 2 575 609 | 7/1986 | France . |
| 78 11 093 | 7/1978 | Germany . |

*Primary Examiner*—Krista M. Zele
*Assistant Examiner*—Devendra T. Kumar
*Attorney, Agent, or Firm*—Spencer & Frank

[57] ABSTRACT

The multiple contact pin holder of a modular connection device for telephone or weak current systems includes a device for solderless insulation displacement wiring which are provided with at least one pivoting cover which can be pressed down onto the body of the contact pin holder and from the contact side of which ribs extend downwards. These ribs enter the body's slits for receiving wires when the pivoting cover is pressed down onto the body and press the inserted wires into the insulation displacers of the contact pins. The slits for receiving wires are provided with lateral retaining projections arranged above one another. At least one retaining projection is located near the spot where the wires are inserted for the purpose of positioning the inserted wire, and the other retaining projection is located near a region of the insulation displacer for the purpose of fastening the wire which is pressed into the insulation displacer.

6 Claims, 1 Drawing Sheet

Fig.1
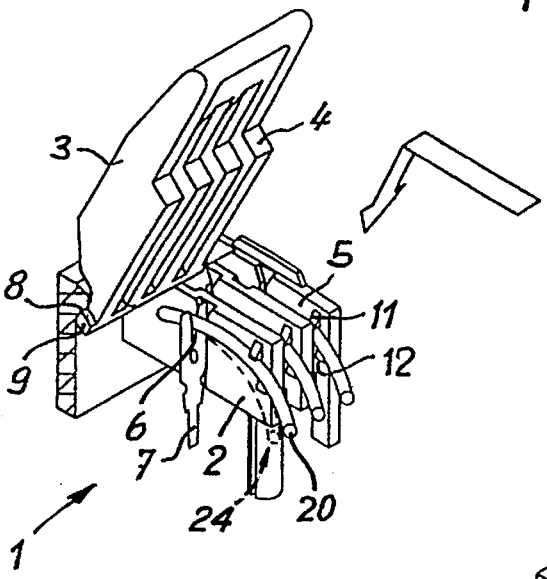
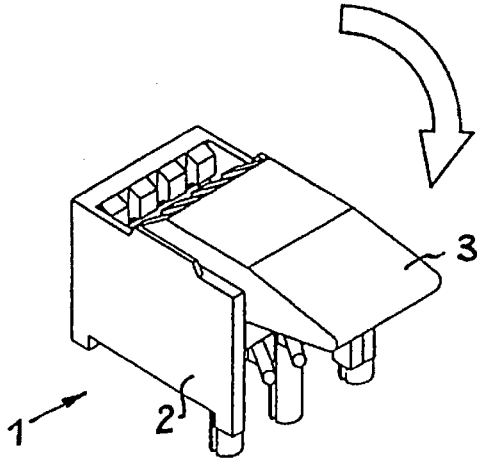
Fig. 2
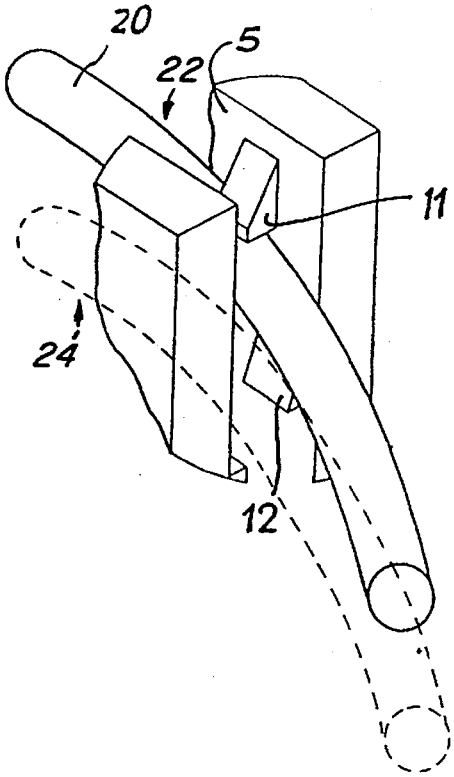
Fig. 3

MULTIPLE CONTACT PIN HOLDER FOR WEAK CURRENT INSTALLATIONS

BACKGROUND OF THE INVENTION

The present invention relates to a multiple contact pin holder of a modular connection device for telephone or weak current systems, with means for solderless insulation displacement wiring, comprising at least one pivoting cover which can be pressed down onto the body of the contact pin holder. The pivoting cover has a contact side with ribs which extend toward the body. The ribs enter slits formed in the body for insertion of the wires when the pivoting cover is pressed down onto the body, and which press the inserted wires into the contact pins' insulation displacers.

Solderless wiring is becoming increasingly important in all areas of weak-current technology. In this context, a multiple contact pin holder of the type described above has been made known by EP-A-O 310 832 from the same applicant.

With this type of arrangement, however, the fact remains that the wires may exit from the body fairly easily before being pressed into the slits, which means that the insertion process must be repeated, which is a problem. The fact that the pivoting cover must remain in position after being pressed down in order to hold the wires in place is a further disadvantage.

SUMMARY OF THE INVENTION

The task of the invention is therefore to create an embodiment of a multiple contact pin holder of the type described above which eliminates these disadvantages.

This task is fulfilled according to the invention in that the slits for receiving the inserted wires are provided with retaining projections arranged above one another. Of these projections, at least one is located near the spot where the wire is inserted for the purpose of positioning the inserted wire, and at least one other retaining projection is located near the insulation displacer for the purpose of fastening the wire which is pressed into the insulation displacer.

Therefore, neither an inserted wire nor one which is pressed in can exit its slit, independently of any locking functions of the pivoting cover.

In order to make accommodations for the increasingly limited available space and improve handling of the pivoting cover, a preferable embodiment would be characterized in that the pivoting cover can be used with ridges on its rear side and can pivot to contact a shoulder on the body's rear side. Further, the pivoting cover may be clamped laterally in such a way that it can be separated from the body when pressed in or is fastened with locks or catches. Moreover, the pivoting cover is at the most flush against the body's rear side when open. Additionally, the pivoting cover can aid in many different ways in pressing wires into the insulation displacers of multiple contact pin holders.

BRIEF DESCRIPTION OF THE DRAWINGS

An example of an embodiment of the subject of the invention is illustrated in more detail below in the drawings, which show the following:

FIG. 1 A diagram of a partial section of a multiple contact pin holder according to the invention with an open pivoting cover;

FIG. 2 The contact pin holder according to FIG. 1 with a closed pivoting cover; and FIG. 3 An enlarged diagram of a section of a slit for receiving wires from the arrangement according to FIG. 1.

DETAILED DESCRIPTION OF THE PREFERRED EMBODIMENTS

The multiple contact pin holder 1 shown in FIGS. 1 and 2 is usually a contact strip provided with a transverse slit 5 for every wire 20. The insulation displacer 6 of a contact pin 7 which extends downward is arranged perpendicularly in each of these slits 5, whereby adjoining contact pins 7 are normally located at different levels (not shown).

The above is already known of multiple contact pin holders. Furthermore, it is also known that the means for insulation displacement wiring comprise a pivoting cover 3 which can be pressed down onto the body (housing) 2 of the contact pin holder 1. Spaced ribs 4 extend downward from the contact side of this pivoting cover 3 and these ribs enter the slits 5 of body 2 when the pivoting cover 3 is pressed down onto it, and press the inserted wires 20 into the insulation displacers 6 of the contact pins 7.

As was stated in the beginning and as can be seen in FIG. 3 in particular, it is important for the invention that the slits 5 are provided with lateral retaining projections 11, 12 arranged above one another. At least one retaining projection 11 is located near a region 22 where the wire is inserted for the purpose of positioning an inserted wire, and the other retaining projection 12 is located in a region 24 of the insulation displacer for the purpose of fastening the wire which is pressed into the insulation displacer.

The features described above prevent the inserted wires from exiting before being pressed into the slits designed to receive them, which otherwise would require that this process be repeated. Furthermore, it is no longer necessary that the pivoting cover remain in position after being pressed down in order to fasten (hold) the inserted wires in place.

In order to make accommodations for the increasingly limited available space and improve handling of the pivoting cover, a preferable embodiment would be characterized in that ridges are attached to the rear side of the pivoting cover 3, and that cover 3 pivots to contact a shoulder 8 on the rear side of body 2, as shown in detail in FIG. 1. In this connection, it is important that the pivoting cover 3 does not extend past the rear side of the body 2, i.e. that it is at the most flush with this rear side, when open.

Furthermore, the pivoting cover 3 is clamped laterally in such a way that it is separable from the body when pressed in, by engaging and disengaging the protrusions 9 of the cover 3 with corresponding indentations (not shown) formed in the body 2. Further, cover 3 can be fastened with locks or catches.

As the inserted wires 20 are held down by the lower projections 12, using the pivoting cover 3 as an aid in many different ways in pressing wires into the insulation displacers of multiple contact pin holders is possible.

Therefore, the result of that which is described above is a multiple contact pin holder of a modular connection device for telephone and weak current systems with means for solderless insulation displacement wiring and that the main problem of fastening of the wires or leads before and after insulation displacement wiring is solved in an optimum way and relatively simply with regard to production and handling.

While there are shown and described preferred embodiments of the invention, it is to be distinctly understood that the invention is not limited thereto but may be embodied and practised within the scope of the following claims.

What I claim is:

1. A multiple contact pin holder of a modular connection device, comprising:

a body having a plurality of slits formed therein for receiving respective wires, each slit being defined by two slit walls with at least one of the slit walls having at least first and second lateral retaining projections arranged above one another and projecting into the respective slit;

a plurality of contact pins, each being located within a respective slit, and each having an insulation displacer located on an end thereof; and at least one cover pivotably attached to said body, said cover having a surface facing said body with a plurality of ribs located on the surface, said ribs being in registration with the slits so that when said cover is pressed onto said body, each said rib enters a respective slit to press a respective wire into a respective insulation displacer to form a solderless insulation displacement wiring connection; whereby the respective first lateral retaining projections are located in a wire insertion region of said body to retain the respective wires in the slits before the cover is pressed onto said body, and the respective second lateral retaining projections are located in an insulation displacer region of said body to engage and fix the respective wires in the slits after the respective wires are pressed into the respective insulation displacers using the cover;

said cover and said body each having a respective rear side, the rear side of said body having a shoulder, and the rear side of said cover having ridges that contact with said shoulder when said cover is pivoted to an open position.

2. The multiple contact pin holder defined in claim 1, wherein said cover is at the most flush with a rear side of said body when pivoted to an open position.

3. The multiple contact pin holder defined in claim 1, wherein said cover is separable from said body, and wherein said second lateral retaining projections fix the respective wires in the slits even when said cover is separated from said body.

4. A multiple contact pin holder of a modular connection device, comprising:

a body having a plurality of slits formed therein for receiving respective wires, each slit being defined by two slit walls with at least one of the slit walls having at least first and second lateral retaining projections arranged above one another and projecting into the respective slit;

a plurality of contact pins, each being located within a respective slit, and each having an insulation displacer located on an end thereof; and at least one cover pivotably attached to said body, said cover having a surface facing said body with a plurality of ribs located on the surface, said ribs being in registration with the slits so that when said cover is pressed onto said body, each said rib enters a respective slit to press a respective wire into a respective insulation displacer to form a solderless insulation displacement wiring connection; whereby the respective first lateral retaining projections are located in a wire insertion region of said body to retain the respective wires in the slits before the cover is pressed onto said body, and the respective second lateral retaining projections are located in an insulation displacer region of said body to engage and fix the respective wires in the slits after the respective wires are pressed into the respective insulation displacers using the cover, said cover being laterally clamped by said body and separable from said body.

5. The multiple contact pin holder defined in claim 4, wherein said second lateral retaining projections fix the respective wires in the slits even when said cover is separated from said body.

6. The multiple contact pin holder defined in claim 4, wherein said cover is at the most flush with a rear side of said body when pivoted to an open position.

* * * * *